US012680714B2

(12) United States Patent
Christian et al.

(10) Patent No.: US 12,680,714 B2
(45) Date of Patent: Jul. 14, 2026

(54) HVAC EQUIPMENT WITH WIRELESS CONNECTIVITY FEATURES

(71) Applicant: Johnson Controls Tyco IP Holdings LLP, Milwaukee, WI (US)

(72) Inventors: Kyle Christian, Noble, OK (US); Randy Raymond Koivisto, Noble, OK (US); Micah Taylor Green, El Reno, OK (US)

(73) Assignee: Tyco Fire & Security GmbH, Neuhausen am Rheinfall (CH)

( * ) Notice: Subject to any disclaimer, the term of this patent is extended or adjusted under 35 U.S.C. 154(b) by 359 days.

(21) Appl. No.: 18/240,227

(22) Filed: Aug. 30, 2023

(65) Prior Publication Data

US 2024/0068691 A1 Feb. 29, 2024

Related U.S. Application Data

(60) Provisional application No. 63/402,350, filed on Aug. 30, 2022.

(51) Int. Cl.

| | |
|---|---|
| ***F24F 11/58*** | (2018.01) |
| ***F24F 11/46*** | (2018.01) |
| ***F24F 11/52*** | (2018.01) |
| ***F24F 11/89*** | (2018.01) |

(52) U.S. Cl.

CPC ..... *F24F 11/58* (2018.01); *F24F 11/52* (2018.01); *F24F 11/89* (2018.01); *F24F 11/46* (2018.01)

(58) Field of Classification Search

None

See application file for complete search history.

(56) References Cited

U.S. PATENT DOCUMENTS

| | | | | |
|---|---|---|---|---|
| 7,571,865 | B2 * | 8/2009 | Nicodem | G05D 23/1934 236/51 |
| 9,024,765 | B2 * | 5/2015 | Hoesl | F24F 11/46 702/182 |
| 9,494,952 | B2 * | 11/2016 | Storm | G05D 23/1905 |
| 9,812,926 | B1 * | 11/2017 | Rodriguez | F03D 9/00 |
| 9,982,903 | B1 * | 5/2018 | Ridder | F24F 11/70 |

(Continued)

FOREIGN PATENT DOCUMENTS

| | | | | |
|---|---|---|---|---|
| CA | 3104281 | A1 * | 12/2019 | G01S 5/0284 |
| CA | 2818696 | C * | 7/2020 | F24F 11/47 |

(Continued)

OTHER PUBLICATIONS

Tammilehto, J., "Wireless building automation in Finland", Jan. 2013, Bachelor's thesis Degree Program of Electrical Engineering Building Services. (Year: 2013).*

(Continued)

*Primary Examiner* — Mohammad Ali
*Assistant Examiner* — Kelvin Booker
(74) *Attorney, Agent, or Firm* — Fletcher Yoder, P.C.

(57) ABSTRACT

A heating, ventilation, and/or air conditioning (HVAC) system in accordance with present embodiments includes a housing, one or more sensing units disposed within the housing, and a controller disposed within the housing. The controller is operable to communicate with the one or more sensing units through a wireless communication link to receive sensed data, and analyze the sensed data by applying one or more data processing techniques.

18 Claims, 6 Drawing Sheets

(56) References Cited

U.S. PATENT DOCUMENTS

| | | | | |
|---|---|---|---|---|
| 10,030,885 | B1 * | 7/2018 | Yu | F24F 11/79 |
| 10,151,502 | B2 * | 12/2018 | Flaherty | F24F 11/62 |
| 10,240,802 | B2 * | 3/2019 | Gonia | F24F 11/76 |
| 10,317,101 | B2 * | 6/2019 | Trikha | H04W 84/12 |
| 10,492,204 | B2 * | 11/2019 | Kakinada | H04W 4/80 |
| 10,605,838 | B2 * | 3/2020 | Seiler | F24F 11/30 |
| 11,754,306 | B2 * | 9/2023 | Gillette | F24F 11/65 700/277 |
| 12,405,020 | B2 * | 9/2025 | Gillette | F24F 11/58 |
| 2007/0109121 | A1 * | 5/2007 | Cohen | H04Q 9/00 340/693.1 |
| 2008/0099568 | A1 * | 5/2008 | Nicodem | F24F 11/64 236/51 |
| 2012/0253521 | A1 * | 10/2012 | Storm | G05B 15/02 236/51 |
| 2013/0176130 | A1 * | 7/2013 | Hoesl | F24F 11/46 340/588 |
| 2015/0369504 | A1 * | 12/2015 | Flaherty | F24F 11/70 700/277 |
| 2015/0370927 | A1 * | 12/2015 | Flaherty | F24F 11/30 703/1 |
| 2017/0356669 | A1 * | 12/2017 | Gonia | F24F 11/63 |
| 2018/0100882 | A1 * | 4/2018 | Seiler | F24F 11/46 |
| 2018/0119972 | A1 * | 5/2018 | Trikha | F24F 11/62 |
| 2018/0209674 | A1 * | 7/2018 | Ridder | F24F 11/30 |
| 2019/0150134 | A1 * | 5/2019 | Kakinada | H04W 16/14 370/330 |
| 2019/0162436 | A1 * | 5/2019 | Albinger | F24F 11/32 |
| 2019/0188934 | A1 * | 6/2019 | Calvert | G07C 9/00571 |
| 2019/0353380 | A1 * | 11/2019 | Gillette | F24F 11/49 |
| 2019/0391227 | A1 * | 12/2019 | Zhang | H04Q 9/00 |
| 2020/0027096 | A1 * | 1/2020 | Cooner | G06Q 40/04 |
| 2020/0088434 | A1 * | 3/2020 | Diaz | F24F 11/56 |
| 2020/0149764 | A1 * | 5/2020 | Sinha | G05D 23/1905 |
| 2021/0071895 | A1 * | 3/2021 | Seidling | F24F 11/56 |
| 2022/0232423 | A1 * | 7/2022 | Thyagaturu | H04W 28/10 |

FOREIGN PATENT DOCUMENTS

| | | | | |
|---|---|---|---|---|
| CA | 3141502 | A1 * | 11/2020 | F24F 11/38 |
| TW | 201245653 | A * | 11/2012 | F24F 11/523 |
| WO | WO-2007019104 | A2 * | 2/2007 | G06K 19/0712 |
| WO | WO-2012068507 | A2 * | 5/2012 | F24F 11/523 |
| WO | WO-2012068591 | A2 * | 5/2012 | F24F 11/47 |

OTHER PUBLICATIONS

Leavey et al., "Air quality metrics and wireless technology to maximize the energy efficiency of HVAC in a working auditorium", Jul. 2014, Building and Environment 85 (2015). (Year: 2014).*

Schlichter et al., "Enabling Energy Efficient HVAC Operation Through IWSNs", Mar. 2021, IEEE Transactions On Green Communications and Networking, vol. 6, No. 1. (Year: 2021).*

Png et al., "An internet of things upgrade for smart and scalable heating, ventilation and air-conditioning control in commercial buildings", Sep. 2018, Applied Energy 239 (2019) 408-424. (Year: 2018).*

* cited by examiner

HVAC EQUIPMENT WITH WIRELESS CONNECTIVITY FEATURES

CROSS-REFERENCE TO RELATED APPLICATIONS

This application claims priority from and the benefit of U.S. Provisional Application Ser. No. 63/402,350, entitled "HVAC Equipment with Wireless Connectivity Features," filed Aug. 30, 2022, which is herein incorporated by reference in its entirety for all purposes.

BACKGROUND

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

The present disclosure relates generally to commercial heating, ventilation, and/or air conditioning (HVAC) equipment. A wide range of applications exist for HVAC systems. For example, residential, light-commercial, commercial, and industrial HVAC systems are used to control temperatures and air quality in buildings. Commercial HVAC systems include packaged units such as packaged terminal air conditioner (PTAC) units, roof top units (RTU), variable refrigerant flow (VRF) units etc., that are self-contained heating and air conditioning units. Such packaged units incorporate a wide range of heating and cooling components contained within the packaged unit to provide comfort to building occupants.

In view HVAC equipment complexities (e.g., the quantity of components that are incorporated into and coordinate to function as HVAC equipment), it is now recognized that there is a need for increased efficiency in such equipment. For example, there is a need to increase efficiency of HVAC equipment assembly, efficiency of HVAC equipment operation, efficiency of coordination between HVAC components, efficiency of space utilization in HVAC equipment, and so forth.

SUMMARY

A summary of certain embodiments disclosed herein is set forth below. It should be noted that these aspects are presented merely to provide the reader with a brief summary of these certain embodiments and that these aspects are not intended to limit the scope of this disclosure. Indeed, this disclosure may encompass a variety of aspects that may not be set forth below.

A heating, ventilation, and/or air conditioning (HVAC) system in accordance with present embodiments includes a housing, one or more sensing units disposed within the housing, and a controller disposed within the housing. The controller is operable to communicate with the one or more sensing units through a wireless communication link to receive sensed data, and analyze the sensed data by applying one or more data processing techniques.

A method in accordance with present embodiments includes monitoring an operation of one or more heating, ventilation, and/or air conditioning (HVAC) devices disposed within a housing of an HVAC system with one or more sensing units disposed with the housing. The method further includes generating, by the one or more sensing units, sensed data based on the monitoring. Additionally, the method includes receiving, by a controller disposed within the housing, the sensed data via a wireless communication link, and analyzing, by the controller, the sensed data by applying one or more data processing techniques.

An air handling unit (AHU) in accordance with present embodiments includes a housing, a controller disposed within the housing, a communications interface of the controller, wherein the communications interface is configured to transmit and receive communications wirelessly. The AHU also includes a sensor disposed within the housing, wherein the sensor is configured to transmit sensed data wirelessly to the controller via the communications interface. Further, the AHU includes an actuator disposed within the housing, wherein the actuator is configured to receive instructions wirelessly from the communications interface and to perform based on the instructions. The controller is configured to control power and/or orientation of the sensor and/or the actuator to manage transmission quality of the sensed data and/or feedback from the actuator.

Those skilled in the art will appreciate that the summary is illustrative only and is not intended to be in any way limiting. Other aspects, inventive features, and advantages of the devices and/or processes described herein, as defined solely by the claims, will become apparent in the detailed description set forth herein and taken in conjunction with the accompanying drawings.

BRIEF DESCRIPTION OF THE DRAWINGS

Various objects, aspects, features, and advantages of the disclosure will become more apparent and better understood by referring to the detailed description taken in conjunction with the accompanying drawings, in which like reference characters identify corresponding elements throughout. In the drawings, like reference numbers generally indicate identical, functionally similar, and/or structurally similar elements.

DETAILED DESCRIPTION

Figure 1:
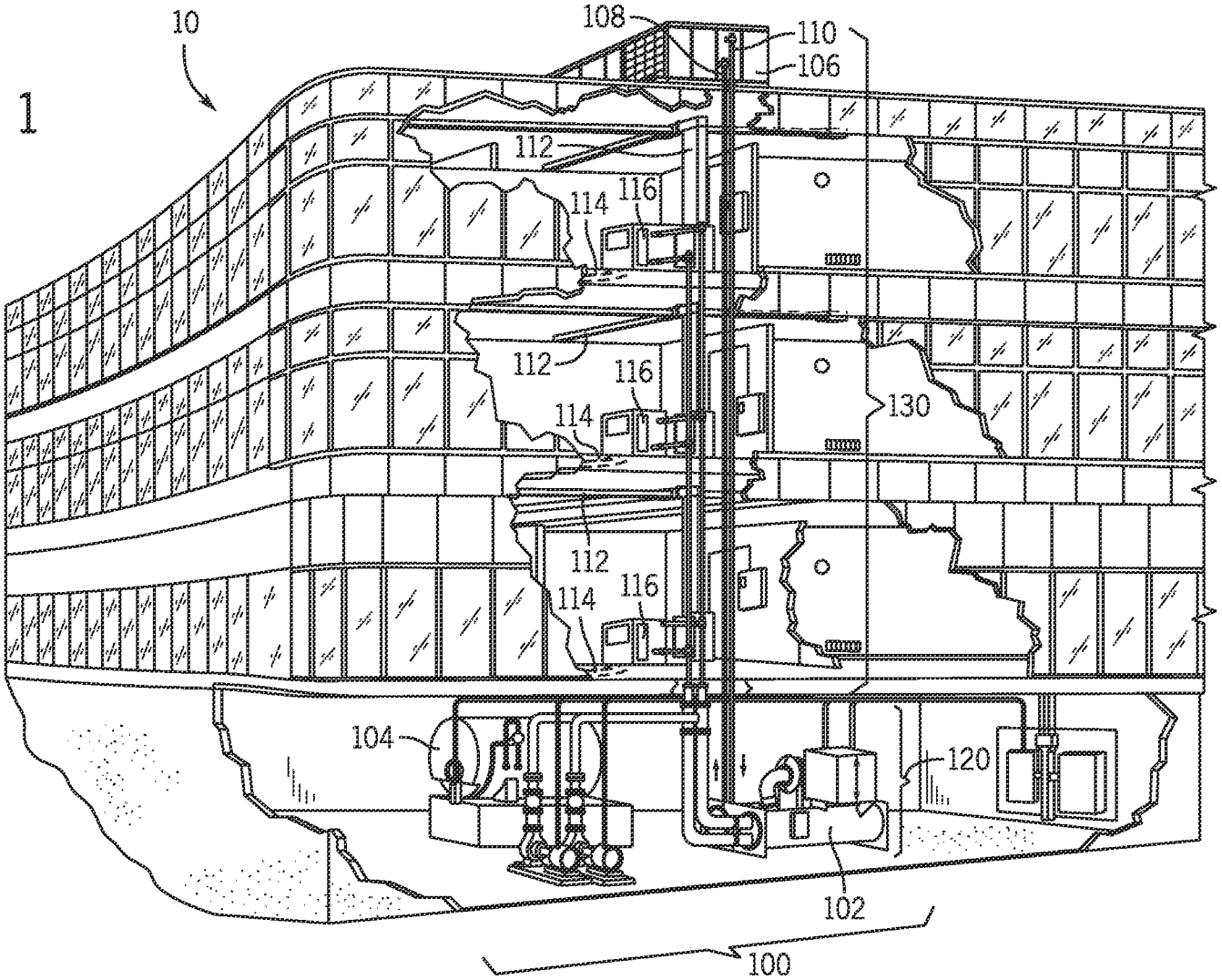
FIG. 1 is a perspective view of a building including a heating, ventilating, or air conditioning (HVAC) system, in accordance with embodiments of the present disclosure.

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but may nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

Heating, ventilation, and/or air-conditioning (HVAC) systems typically include a thermostat to facilitate temperature regulation, a refrigerant or working fluid circuit (e.g., a compressor, a condenser, an expansion valve, and an evaporator), a controller, and numerous different sensors, actuators, valves, and so forth. Many of these components require communication capabilities. For example, sensors, controllers, and actuators must be capable of supplying and/or receiving communications to facilitate system control (e.g., maintenance of desired conditions within the HVAC system). In conventional HVAC package units, system components are generally communicatively coupled to a controller (e.g., a central control board) via wiring that extends throughout respective housings of such HVAC package units. In such systems, the controller relies on wired connections with various components for data acquisition inputs and operational outputs. For example, in such systems the controller uses a large number of wired connections running throughout the packaged unit to receive data on sensed operating conditions (e.g., temperature, pressure, flow) and to transmit commands to various mechanical components (e.g., compressors, condenser fans, valves). The controller may utilize control algorithms to process input data and control system components to achieve a desired climate (e.g., temperature) control. Further, the controller (which may include multiple controllers) may operate to detect faults, perform diagnostics, load shed, detect occupancy, and so forth. It is now recognized that such operations and corresponding wired connections impose design constraints. The wired connections are now understood to be limited in flexibility, accessibility, and data acquisition capabilities. Additionally, these wired connections increase cost and complexity of installation. Accordingly, present embodiments are directed to providing wireless connectivity within HVAC equipment (e.g., inside the housing of an HVAC package unit).

The present disclosure describes an HVAC system (e.g., HVAC equipment) that includes features that address shortcomings of conventional HVAC systems. As previously noted, the components in conventional HVAC systems, such as packaged units, are generally wired throughout a system housing to facilitate internal communications (e.g., communications from sensors to a control board). For example, HVAC components are typically connected to a central control board, such as a SIMPLICITY SMART EQUIPMENT (SSE) control board via wired connections. Such wired connections impose design constraints and are limited in flexibility, accessibility, and data acquisition capabilities. For example, wiring channels and/or passages within an HVAC housing are often required to store or provide space for wire runs that are passing throughout the housing.

Present embodiments employ wireless technology to facilitate internal communications for an HVAC system to eliminate bulky wires and space-consuming wiring guides. Small, low energy wireless controllers may be placed throughout an HVAC system and may operate at lower voltage than a traditional central control board (e.g., SSE control board) and accessories. An HVAC system's housing may cause interference to such wireless communications (e.g., operate similarly to a Faraday shield or cage) when wireless signals encounter the housing. Thus, in accordance with present embodiments, wireless communication features may be configured for directional communication to avoid such interference. For example, a sensor may be specifically configured to direct wireless signals to a controller or an actuator based on positioning of these features inside the HVAC housing to avoid undesired interference. Further, certain positional aspects may be adjustable (e.g., via an articulating joint) to achieve desired communication strengths based on variable positioning of features. Also, a controller (e.g., the HVAC controller) may function to control power to certain sensors to facilitate transmission and dynamically adjust transmitter power based on conditions and circumstances. Further, the HVAC system may include an external antenna that can be employed to transmit certain data (e.g., data from a particular sensor or from the controller) outside of the housing (e.g., to another HVAC package unit). As with the other communication features, power may be controlled to the antenna to adjust for range. Power to the various wireless communication features may be controlled to conserve energy. For example, communication between closely spaced internal components may be assigned very limited power because little power is needed, whereas external communication (e.g., via an external antenna) may be assigned higher levels of power to achieve longer distance communications. It should be noted that, to the extent wireless connectivity has been utilized in relation to HVAC systems, it is believed that such wireless connectivity relies on external controllers or supplementary devices. In contrast, present embodiments are directed to reducing wired connections in HVAC systems (e.g., within a housing for a package unit) by providing a network of cloud connected wireless devices within (e.g., fully disposed within) a packaged unit.

Referring now to FIG. 1, a perspective view of a building 10 is shown. Building 10 is served by a heating, ventilating, or air conditioning (HVAC) system 100. HVAC system 100 can include a plurality of HVAC devices (e.g., heaters, chillers, air handling units, pumps, fans, thermal energy storage, etc.) configured to provide heating, cooling, air conditioning, ventilation, and/or other services for the building 10. For example, the HVAC system 100 is shown to include a waterside system 120 and an airside system 130. The waterside system 120 may provide a heated or chilled fluid to an air handling unit of the airside system 130. The airside system 130 may use the heated or chilled fluid to heat or cool an airflow provided to the building 10.

The HVAC system 100 is shown to include a chiller 102, a boiler 104, and a rooftop air handling unit (AHU) 106. The waterside system 120 may use the boiler 104 and the chiller 102 to heat or cool a working fluid (e.g., water, glycol, etc.) and may circulate the working fluid to the AHU 106. In various embodiments, the HVAC devices of the waterside system 120 can be located in or around the building 10 (as shown in FIG. 1) or at an offsite location such as a central plant (e.g., a chiller plant, a steam plant, a heat plant, etc.) that serves one or more buildings including the building 10. The working fluid can be heated in the boiler 104 or cooled in the chiller 102, depending on whether heating or cooling is required in the building 10. The boiler 104 may add heat to the circulated fluid, for example, by burning a combustible material (e.g., natural gas) or using an electric heating element. The chiller 102 may place the circulated fluid in a heat exchange relationship with another fluid (e.g., a refrigerant) in a heat exchanger (e.g., an evaporator) to absorb heat from the circulated fluid. The working fluid from the chiller 102 and/or the boiler 104 can be transported to the AHU 106 via piping 108.

The AHU 106 may place the working fluid in a heat exchange relationship with an airflow passing through the AHU 106 (e.g., via one or more stages of cooling coils and/or heating coils). The airflow can be, for example, outside air, return air from within the building 10, or a combination of both. The AHU 106 may transfer heat between the airflow and the working fluid to provide heating or cooling for the airflow. For example, the AHU 106 can include one or more fans or blowers configured to pass the airflow over or through a heat exchanger containing the working fluid. The working fluid may then return to the chiller 102 or the boiler 104 via piping 110.

The airside system 130 may deliver the airflow supplied by the AHU 106 (i.e., the supply airflow) to the building 10 via air supply ducts 112 and may provide return air from the building 10 to the AHU 106 via air return ducts 114. In some embodiments, the airside system 130 includes multiple variable air volume (VAV) units 116. For example, the airside system 130 is shown to include a separate VAV unit 116 on each floor or zone of the building 10. The VAV units 116 can include dampers or other flow control elements that can be operated to control an amount of the supply airflow provided to individual zones of the building 10. In other embodiments, the airside system 130 delivers the supply airflow into one or more zones of the building 10 (e.g., via the supply ducts 112) without using intermediate VAV units 116 or other flow control elements. The AHU 106 can include various sensors (e.g., temperature sensors, pressure sensors, etc.) configured to measure attributes of the supply airflow. The AHU 106 may receive input from sensors located within the AHU 106 and/or within the building zone and may adjust the flow rate, temperature, or other attributes of the supply airflow through the AHU 106 to achieve set point conditions for the building zone.

The various functions of the HVAC system 100 and its various components (e.g., functions of the AHU 106) are achieved based on data communications. For example, as noted above, the AHU 106 may receive input data from internal sensors (sensors within the AHU 106) and may make adjustments (e.g., throttle a valve to control flow rate through the AHU 106) based on the data from the internal sensors. Indeed, a controller of the HVAC system 100 (e.g., a controller of the AHU 106) may receive the input data, perform an algorithm, and output control data to an actuator to achieve a desired control operation. In accordance with the present disclosure, wireless sensing and control features may be incorporated into any individual or combination of the various components of the HVAC system 100 to facilitate such communication and/or control. More specifically, certain embodiments are directed to incorporation of wireless sensing and control features within a component housing for internal communications (e.g., communication within the AHU 106 and a housing thereof). Further, certain embodiments are directed to orienting (including dynamically orienting) associated wireless devices (e.g., to specifically direct signals) and control of power to such devices to conserve energy and reduce undesired data communications outside of certain boundaries.

Figure 2:
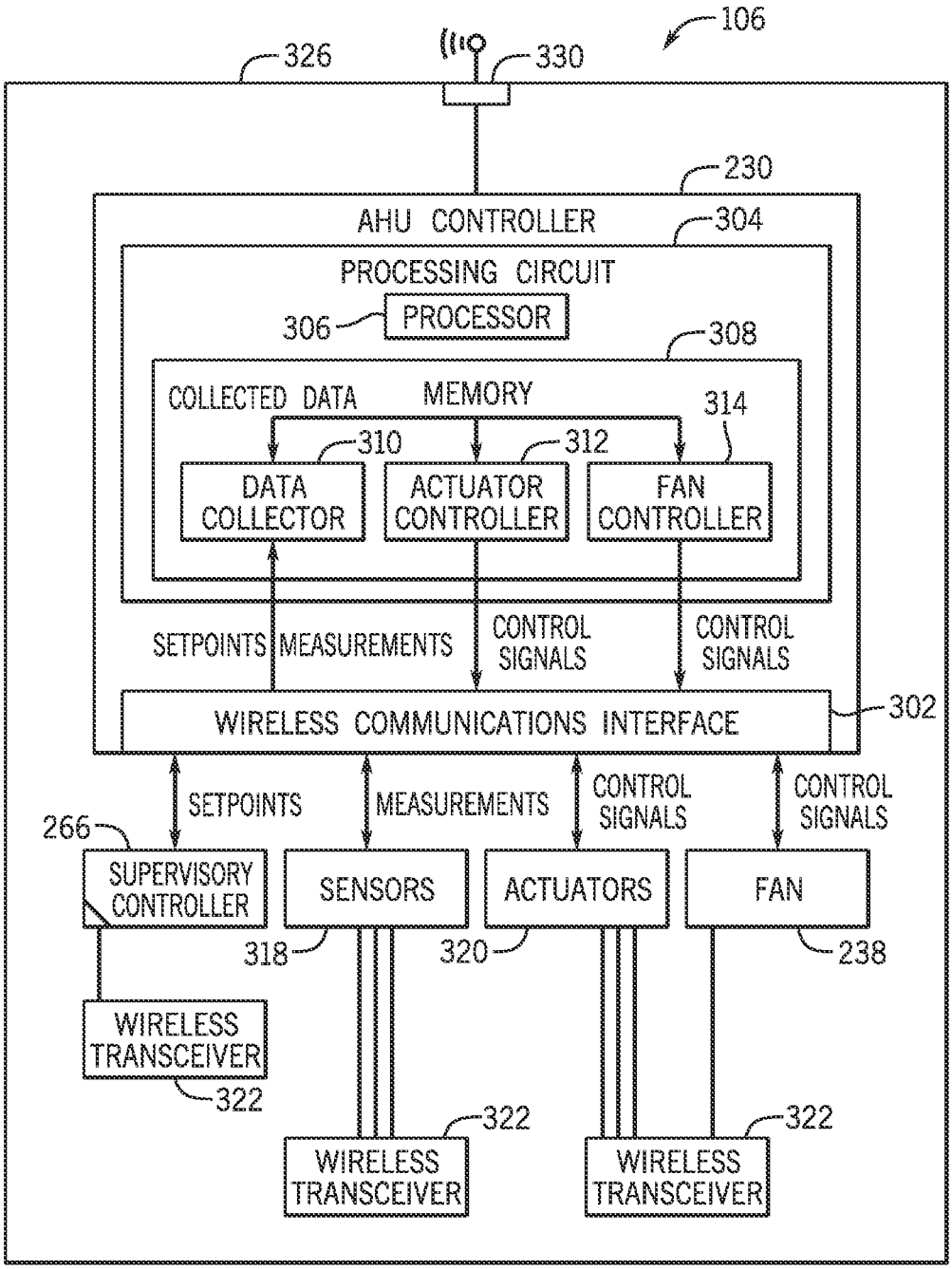
FIG. 2 is a block diagram of an air-handling unit (AHU), in accordance with embodiments of the present disclosure.

Referring now to FIG. 2, a block diagram illustrating and AHU controller 230 is provided, according to an exemplary embodiment. The AHU controller 230 includes logic that adjusts control signals to achieve a target outcome. In some operating modes, the control logic implemented by AHU controller 230 utilizes feedback of an output variable. The logic implemented by AHU controller 230 may also or alternatively vary a manipulated variable based on a received input signal (e.g., a set point). Such a set point may be received from a user control (e.g., a thermostat), a supervisory controller (e.g., supervisory controller), or another upstream device via a communications network (e.g., a BACnet network, a LonWorks network, a LAN, a WAN, the Internet, a cellular network, etc.).

In the illustrated embodiment, the AHU controller 230 includes a communications interface 302 (e.g., a wireless transceiver) and a processing circuit 304 (representative of processing circuitry). The processing circuit 304 includes a processor 306 (representative of one or more processors) and memory 308 (representative of one more memory devices). The processor 306 may be a general purpose or specific purpose processor, an application specific integrated circuit (ASIC), one or more field programmable gate arrays (FPGAs), a group of processing components, or other suitable processing components. The processor 306 is configured to execute computer code or instructions stored in memory 308 or received from other computer readable media (e.g., CDROM, network storage, a remote server, etc.). The memory 308 may include one or more devices (e.g., memory units, memory devices, storage devices, etc.) for storing data and/or computer code for completing and/or facilitating the various processes described in the present disclosure. The memory 308 may include random access memory (RAM), read-only memory (ROM), hard drive storage, temporary storage, non-volatile memory, flash memory, optical memory, or any other suitable memory for storing software objects and/or computer instructions. The memory 308 may include database components, object code components, script components, or any other type of information structure for supporting the various activities and information structures described in the present disclosure. The memory 308 may be communicably connected to processor 306 via processing circuit 304 and may include computer code for executing (e.g., by the processor 306) one or more processes described herein.

The memory 308 can include any of a variety of functional components (e.g., stored instructions or programs) that provide AHU controller 230 with the ability to perform monitoring and control operations. The memory 308 may store instructions that, when executed by the processor 306 cause the AHU controller 230 to perform certain operations and controls. The AHU controller 230 may be configured to monitor and control various components of an AHU (e.g., the AHU 106) using any of a variety of control techniques (e.g., state-based control, on/off control, proportional control, proportional-integral (PI) control, proportional-integral-derivative (PID) control, extremum seeking control (ESC), model predictive control (MPC), etc.).

Specifically, in the illustrated embodiment, the memory 308 includes various software modules such as a data collector 310, an actuator controller 312, and a fan controller 314. The data collector 310 may operate to collect data from system components. For example, the data collector 310 may collect data received via the communications interface 302 (e.g., set points, measurements, feedback from actuators 320 and fan 238, etc.). This may include scraping data, receiving data, selecting data, filtering data, and so forth. Data output from the data collector 310 may be provided to the actuator controller 312 and the fan controller 313, which each may process the data (e.g., pass it through a control algorithm) and output control instructions to system components. It should be noted that different control features may be implemented in accordance with present techniques. The particular type of control methodology used by the actuator controller 312 and the fan controller 314 (e.g., state-based control, PI control, PID control, ESC, MPC, etc.) may vary depending on the configuration of AHU controller 230 and can be adapted for various implementations.

Further, the software modules 310, 312, and 314 may also represent hardware modules (e.g., hard circuitry) that can perform the same or similar operations. Such hardware modules may be individually configured communicate wirelessly or may communicate via the communication interface 302, which is wireless in accordance with an embodiment of the present disclosure.

In operation, the AHU controller 230 may wirelessly receive set points from a supervisory controller 266 and measurements from sensors 318. Further, the AHU controller 230 may wirelessly provide control signals to actuators 320 and a fan 238. Any or all of these components (e.g., the supervisory controller 266, the sensors 318, the actuators 320, and/or the fan 238) may be configured to communicate wirelessly with the AHU controller 230. For example, one or more sensors (e.g., sensors 318), actuators (e.g., actuators 32), and/or other components (e.g., fan 238) may couple with or incorporate one or more wireless transceivers 322. In the illustrated embodiment, the supervisory controller 266 incorporates a wireless transceiver 322, the sensors 318 are each coupled to a shared wireless transceiver 322, and the actuators 320 and the fan 238 are all coupled with a shared single wireless transceiver 322.

The sensors 318 may include any sensor configured to monitor any of a variety of variables used by the AHU controller 230 to facilitate monitoring and/or control. Variables monitored by the sensors 318 may include, for example, zone air temperature, zone air humidity, zone occupancy, zone CO2 levels, zone particulate matter (PM) levels, outdoor air temperature, outdoor air humidity, outdoor air CO2 levels, outdoor air PM levels, damper positions, valve positions, fan status, supply air temperature, supply air flowrate, or any other variable relevant to operation of the AHU controller 230.

The actuators 320 may include any actuator controllable by the AHU controller 230. For example, the actuators 320 may include an actuator configured to operate an exhaust air damper, an actuator configured to operate a mixing damper, an actuator configured to operate an outside air damper, an actuator configured to operate a valve (e.g., an expansion valve) or the like. The actuators 320 may receive control signals from and provide feedback signals to the AHU controller 230 via the communications interface 302 and the wireless transceiver 322. As shown in the illustrated embodiment of FIG. 2, the actuators 320 may all share the same transceiver 322. However, each of the actuators 320 may also couple with or incorporate its own wireless transceiver 322 in accordance with present embodiments.

The AHU controller 230 may control an AHU (e.g., the AHU 106) by controllably changing and outputting wireless control signals provided to the actuators 320 and the fan 238 (or other system components). In some embodiments, the control signals include commands for the actuators 320 to set dampers and/or valves to specific positions to achieve a target value for a variable of interest (e.g., supply air temperature, supply air humidity, flow rate, etc.). In some embodiments, the control signals include commands for the fan 238 to operate a specific operating speed or to achieve a specific airflow rate. The control signals may be provided to the actuators 320 and the fan 238 via the wireless communications interface 302. This wireless communication interface 302 may represent a single component or multiple components. Because the referenced wireless communications may occur within a housing 326 (e.g., a control panel, a control cabinet, protective structure of an HVAC unit), certain physical features may create interference for the wireless communications. Accordingly, in an embodiment of the present disclosure, the wireless communication interface 302 and the wireless transceiver(s) 322 may be configured for directional orientation. That is, wireless transmission features may be adjustable (e.g., capable of articulation) to control a direction of transmission and to increase focus of wireless transmissions. In some embodiments, this function may be automated. Further, power levels for individual transmitters (e.g. wireless transceivers 322) may be controlled (e.g., by the AHU controller 230) to conserve energy, limit transmission outside of the housing 326, or otherwise provide optimization steps. When transmission outside of the housing 326 is desired (e.g., to communicate a set point, alert, measurement, or the like) to an external component (e.g., another HVAC component within a shared building), the AHU controller 230 may be operable to direct communications through an antenna 330 positioned at least partially external to the housing 326. Partially external positioning may include positioning within a portion of the housing 326 that is designed to prevent operation as a Faraday shield or cage (e.g., a portion with openings separating extensions spaced apart sufficiently to avoid interference with designated wavelengths of communication).

The communications interface 302 can be or include wireless and also wired communications interfaces (e.g., jacks, antennas, transmitters, receivers, transceivers, wire terminals, etc.) for conducting data communications with various components of the AHU 202 or other external systems or devices. In various embodiments, communications via the communications interface 302 can be direct (e.g., local wired or wireless communications) or via a communications network (e.g., a WAN, the Internet, a cellular network, etc.). For example, the communications interface 302 can include an Ethernet card and port for sending and receiving data via an Ethernet-based communications link or network. In another example, the communications interface 302 can include a Wi-Fi transceiver for communicating via a wireless communications network. In another example, communications interface 302 can include a cellular or mobile phone transceiver, a power line communications interface, an Ethernet interface, or any other type of communications interface. While present embodiments are directed to conserving space, energy, and generating other efficiencies (e.g., costs savings) with wireless communications, certain communications may still benefit from directly wired communication links, such as a wired communicative coupling between the communications interface 302 and the processing circuit 304 (e.g., a control board).

Figure 3:
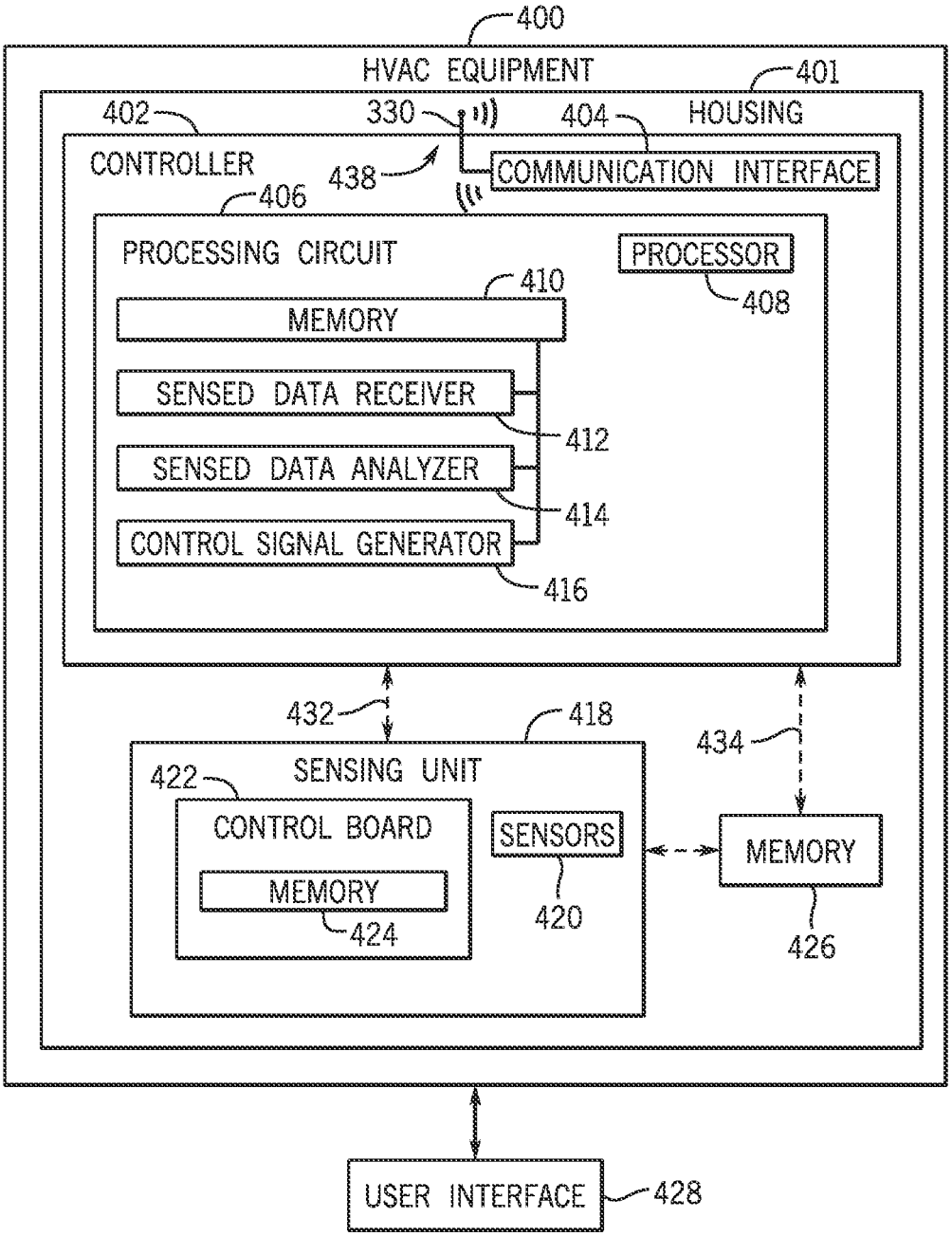
FIG. 3 is a block diagram of HVAC equipment, in accordance with embodiments of the present disclosure.

FIG. 3 is a block diagram illustrating HVAC equipment 400 in accordance with an embodiment of the present disclosure. The HVAC equipment 400 can be a part of the HVAC system 100 described above with respect to FIG. 1, for example. The HVAC equipment 400 is shown to include a housing 401. The housing 401 is further shown to include, disposed therein, a controller 402 (representing one or more such controllers operating together or separately), one or more sensing units 418, and one or more HVAC devices 426. The controller 402 may be a low voltage wireless controller, for example, the controller 402 may be a 3.3V controller. The controller 402 is shown to include a communication interface 404 and a processing circuit 406. The communication interface 404 may include wireless interfaces (e.g., antennas, transmitters, receivers, transceivers, etc.) for conducting data communications with various systems, devices, or networks and may use a variety of communication protocols. For example, the communication interface 404 may include a Wi-Fi transceiver for communicating via a wireless communications network. In some embodiments, the communication interface 404 can be the communication interface of the HVAC system 100 described above with respect to FIG. 1.

The communication interface 404 may be a network interface configured to facilitate electronic data communications between the controller 402 and various external systems or devices (e.g., the sensing unit 418, one or more user interfaces 428, BACnet devices, IoT networks, etc.). Unlike the control boards of conventional HVAC equipment, the controller 402 is provided with built-in wireless connectivity through the communication interface 404 that allows the controller 402 to communicate with other devices without requiring any external controllers or supplementary devices. It should be noted that the communication interface 404 may include an antenna 330 that extends outwardly from the housing 401 to facilitate external communications.

The processing circuit 406 is shown to include a processor 408 (representing one or more processors) and a memory 410 (representing one or more memories). In some embodiments, the processing circuit 406 can be the processing circuit of the HVAC system 100 described above with respect to FIG. 1. The processor 408 may be a general purpose or specific purpose processor, an application specific integrated circuit (ASIC), one or more field programmable gate arrays (FPGAs), a group of processing components, or other suitable processing components. The processor 408 may be configured to execute computer code or instructions stored in the memory 410 or received from other computer readable media (e.g., CDROM, network storage, a remote server, etc.).

The memory 410 may include one or more devices (e.g., memory units, memory devices, storage devices, etc.) for storing data and/or computer code for completing and/or facilitating the various processes described in the present disclosure. The memory 410 may include random access memory (RAM), read-only memory (ROM), hard drive storage, temporary storage, non-volatile memory, flash memory, optical memory, or any other suitable memory for storing software objects and/or computer instructions. The memory 410 may include database components, object code components, script components, or any other type of information structure for supporting various activities and information structures described in the present disclosure. The memory 410 may be communicably connected to the processor 408 via the processing circuit 406 and may include computer code for executing (e.g., by processor 408) one or more processes described herein, including processes for managing wireless communications (e.g., directing wireless signals, controlling signal strength).

In the illustrated embodiment, the HVAC equipment 400 is shown to be in communication with the user interface 428. Such communication may be achieved wirelessly via the communication interface 404. In some embodiments, the user interface 428 may be associated with an electronic device of a user. In some embodiments, the electronic device can be one of, but not limited to a mobile device, smartphone, laptop, desktop, personal digital assistant (PDA), tablet, or any other electronic device with communication capabilities. The user interface 428 may communicate directly of via manager device with sensors, actuators, and so forth of the HVAC equipment based on wireless communication capabilities of such features. Indeed, the user interface 428 functions as a web based user interface that can operate remotely in conjunction with a manager device that sends/receives data from subordinate wireless sensors, actuators and so forth.

The HVAC equipment 400 is shown to include the one or more HVAC devices 426. The HVAC devices 426 may include one or more dampers, valves, fans, economizers etc. The HVAC devices 426 may also include one or more drives configured to control speed of pumps, fans and compressor motors. Drives may include one or more of variable speed drives (VSD), variable frequency drives (VFD) etc. The HVAC devices 426 may also include one or more actuators. For example, one or more actuators configured to operate exhaust air damper, one or more actuators configured to operate mixing damper, one or more actuators configured to operate outside air damper, one or more actuators configured to operate valves.

The HVAC equipment 400 is also shown to include the one or more sensing units 418. The sensing units 418 may include one or more sensors 420 for monitoring an operation of the one or more HVAC devices 426. In some embodiments, the sensors 420 may be wireless IoT sensors. For example, the sensors 420 may be temperature sensors, pressure sensors, humidity sensors etc. The sensors 420 may be configured to sense one or more parameters such as temperature, humidity, pressure, air quality, fan speed, on/off states, CO2 levels, particulate matter (PM) levels, damper positions, valve positions, fan status, supply air temperature, supply air flowrate, zone occupancy etc., pertaining to the one or more HVAC devices 426.

The sensing unit 418 may include a control board 422. In some embodiments, the control board 422 may be low voltage wireless control board. The control board 422 may be configured to obtain one or more sensed signals from the sensors 420 and process the sensed signals to generate sensed data pertaining to the parameters comprising one or more of temperature, humidity, pressure, air quality, and fan speed. The sensed data may include one or more sensed values for the one or more parameters pertaining to the one or more HVAC devices 426. Further, the sensing unit 418 may have a communication module 424 to facilitate communication of the sensing unit 418 with the controller 402 and HVAC devices 426. Communication module 424 may include wireless interfaces (e.g., antennas, transmitters, receivers, transceivers, etc.) for conducting data communications with various systems, devices, or networks. For example, the communication module 424 may include a Wi-Fi transceiver for communicating via a wireless communications network.

The controller 402 may employ one or more communication interfaces such as GPIO (General-purpose input/output), I2C (Inter-Integrated Circuit), UART Universal asynchronous receiver-transmitter, and/or SPI (Serial Peripheral Interface). The controller 402 and the control board 422 may be wireless cloud connected controllers and transmit the information pertaining to the HVAC devices 426 to a cloud-based control system using one or more communication protocols such as Wi-Fi, Lora Wan etc. Such wireless controllers of the HVAC equipment 400 replace wired connections in conventional HVAC equipment, thereby reducing wiring design constraints and improving accessibility in the HVAC equipment 400.

In the illustrated embodiment, the HVAC equipment 400 is shown to include a sensed data receiver 412. The sensed data receiver 412 may be configured to communicate with the one or more sensing units 418 through the wireless communication link 432 to receive the sensed data. The sensed data receiver 412 may be a hardware component, a software component (e.g., a software application or module stored on the memory 410), or a combination thereof. The controller 402 may be configured to communicate with the sensing unit 418 using one of a plurality of communication protocols such as Wi-Fi, MQTT (Message Queueing Telemetry Transport), Lora WAN, Zigbee, Z-wave, NB-IOT (Narrow Band-Internet of things), RFID (Radio Frequency Identification), Bluetooth, NFC (Near Field Communication).

In some embodiments, the sensed data receiver 412 may receive the sensed data for the one or more parameters pertaining to the HVAC devices 426. As referred above, the parameters may include temperature, humidity, pressure, air quality, fan speed, on/off states, CO2 levels, particulate matter (PM) levels, damper positions, valve positions, fan status, supply air temperature, supply air flowrate, zone occupancy etc. The sensed data received by the sensed data receiver 412 may be used by the controller 402 to monitor or control a variable state or condition within the building.

The HVAC equipment 400 is further shown to include a sensed data analyzer 414. The sensed data analyzer 414 may be configured to communicate with the sensed data receiver 412 to receive the sensed data. The sensed data analyzer 414 may be configured to analyze the sensed data using one or more data processing techniques including, but not limited to, artificial intelligence, neural network, machine learning techniques such as decision trees etc. The sensed data may be processed and formatted by the sensed data analyzer 414 by performing one or more operations such as data cleaning, data wrangling, data mining, filtering etc. In one embodiment, the sensed data analyzer 414 may be configured to analyze the sensed data with respect to a pre-defined threshold range to determine if the sensed data is within the pre-defined threshold range. In some embodiments, the sensed data may be transmitted to a cloud-based control system to perform analysis of the sensed data.

Still further, the HVAC equipment 400 is shown to include a control signal generator 416. The control signal generator 416 may be configured to communicate with the sensed data analyzer 414. The control signal generator 416 may be further configured to generate one or more control signals for one or more HVAC devices 426 based on the analysis of the sensed data performed by the sensed data analyzer 414. In some embodiments, the control signal generator 416 may receive set points from the user interface 428 and sensed data analyzed by the sensed data analyzer 414 for generating one or more control signals to operate the one or more HVAC devices 426 such as actuators and fans. The control signals may include one or more commands for actuators to set dampers and/or valves to specific positions to achieve a target value for a variable of interest (e.g., supply air temperature, supply air humidity, flow rate, etc.). Further, the control signals may include one or more commands for one or more drives to operate at a specific operating speed or to achieve a specific airflow rate. In some embodiments, the control signal generator 416 may be configured to monitor and operate the one or more HVAC devices 426 using any of a variety of control techniques (e.g., state-based control, on/off control, proportional control, proportional-integral (PI) control, proportional-integral-derivative (PID) control, extremum seeking control (ESC), model predictive control (MPC), etc.).

The control signal generator 416 may also determine and communicate a power level for particular data communications based on the equipment involved. For example, based on positioning of relevant components, more or less power may be desirable for ensuring communications are completed between transmitting and receiving devices. Specifically, for example, additional power may be need to transmit data to an actuator positioned a relatively long distance away from the communication interface 404 (or separated by internal components, such as control boards, valves, batteries) while less power may be needed to communicate with an actuator positioned very close to the communication interface 404, allowing for conservation of energy. The signal generator 416 may also take into account and/or control directional aspects of communications (e.g., where a signal is directed by positioning of a transceiver). For example, the signal generator 416 may instruct articulation of a transceiver or control power based on orientation of a transceiver.

In some embodiments, the control signals generated by the control signal generator 416 may be transmitted to the HVAC devices 426 via the sensing unit 418 or directly through wireless communication links 432 and 434, respectively. The control signal generator 416 may transmit the control signals via the wireless communication link 432 to the sensing unit 418, which may use the control signals as input to adjust positions of dampers, control relative proportions of outside air and return air provided to a building zone. For example, the control signal generator 416 may transmit a control signal to the sensing unit 418 via the wireless communication link 432 to maintain a speed of an HVAC device 426, such as variable frequency drive. In another example, the control signal generator 416 may transmit one or more control signals to the sensing unit 418 indicating commands on when to turn on a compressor, speed settings of fans, and/or position signals to set an economizer. In another embodiment, the control signal generator 416 may transmit the control signals directly to the HVAC devices 426 via the wireless communication link 434.

Further, the control signal generator 416 may include a control logic that adjusts the control signals to achieve a target outcome. The control logic implemented by the control signal generator 416 may also or alternatively vary a manipulated variable based on a received input signal (e.g., a set point). Such a set point may be received from a user interface 428 (e.g., a thermostat), or other devices connected to the HVAC equipment 400. As previously noted, control of directionality and power may also be managed by the control signal generator 416.

The controller 402 may provide a visualization of information pertaining to the HVAC devices 426 on the user interface 428. The visualization of information may allow a user of the user interface 428 to access the HVAC devices 426 directly from the user interface 428. For example, a user may be able to access the information such as sensed data for parameters, set points, status information, device identifiers, historical trend data, or other applicable data associated with the one or more HVAC devices 426. Additionally, the user interface 428 may allow users to provide one or more commands to modify the information pertaining to the HVAC devices 426 such as set points etc. In some embodiments, the user interface 428 may be configured to access and control the one or more HVAC devices 426 using an application installed on the user interface 428. For example, the user interface 428 may display one or more parameters such as temperature, humidity, fan speed, damper position. A user may select a parameter to view details pertaining to the selected parameter using the user interface 428 and provide one or more commands to control the parameters. Communications between the user interface 428 (including the device supporting a software-based user interface) may be achieved using the antenna 330 in some embodiments because the antenna 330 may be exposed or positioned in an accessible (non-Faraday caged or shielded area) location 438 of the housing 401.

Figure 4:
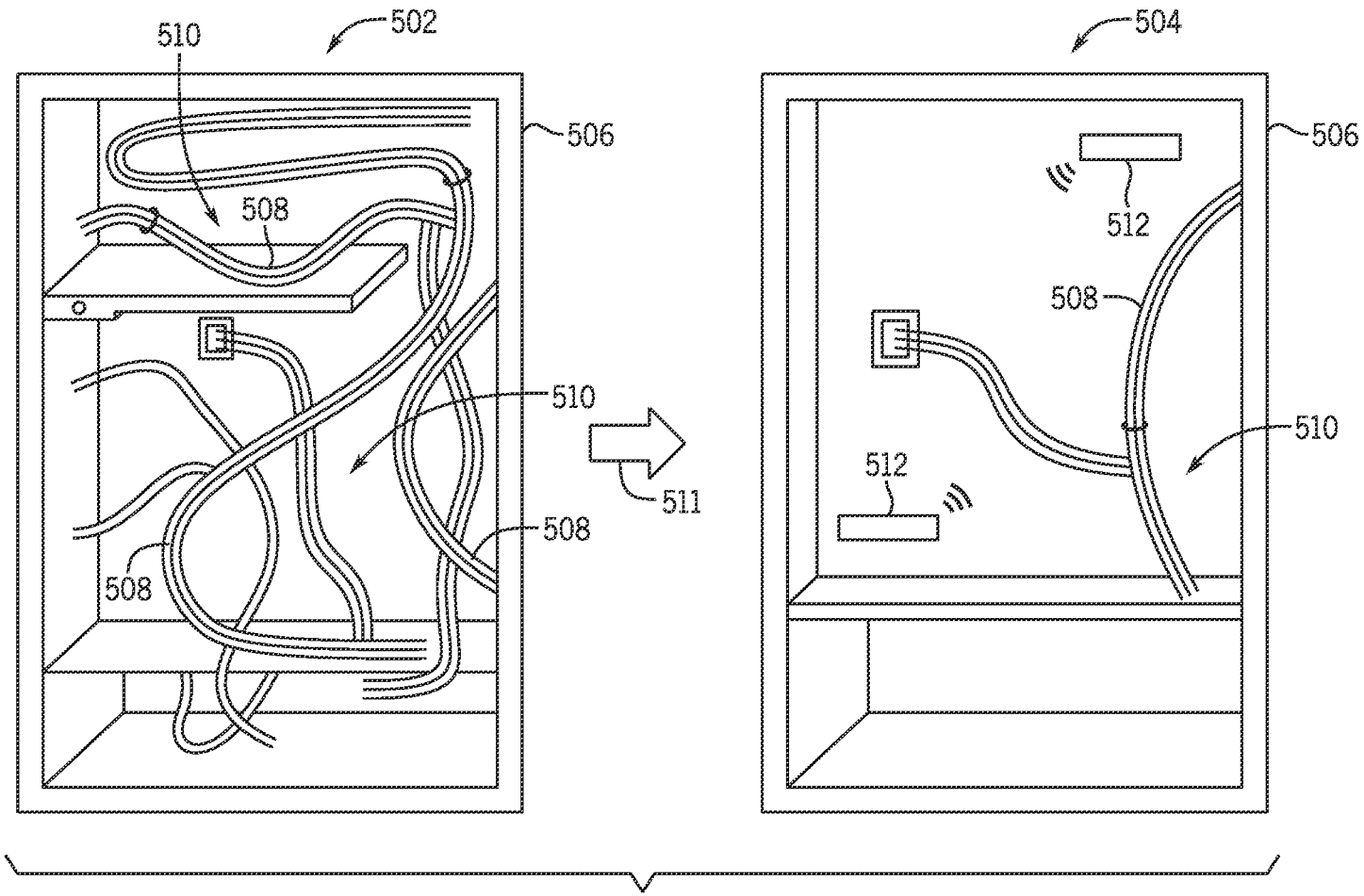
FIG. 4 is a block diagram illustrating traditional HVAC equipment transitioning into more efficient HVAC equipment, in accordance with embodiments of the present disclosure.

Further, in some embodiments, the controller 402 and the control board 422 of the sensing unit 418 may be powered using rechargeable batteries. The controller 402 and the control board 422 may also be powered (e.g., directly or via recharging of the batteries) using one or more wireless power transfer techniques such as inductive coupling, capacitive coupling, lasers, microwaves, piezoelectricity based charging. Further, the controller 402 and the control board 422 may be charged using thermoelectric-generator-based charging that involves generating voltage from one or more of temperature gradient, refrigerant line temperature gradients, evaporator and condenser coils, gas and electric heaters etc. Because actuators, sensors, and other devices may communicate wirelessly in accordance with present embodiments, such features may also employ rechargeable batteries that can be recharged with the methods discussed above Referring now to FIG. 4 a transition from a conventional HVAC system component 502 (e.g., a control cabinet) with traditional wired connections to an HVAC system component 504 in accordance with present embodiments is shown. In conventional commercial HVAC equipment, various components are communicatively coupled via wiring throughout (e.g., throughout a packaged unit) a housing 506 and connected to the central control board. The control board relies on cumbersome wired connections to various components for receiving data and providing operational outputs. Such wired connections impose design constraints and are limited in flexibility, accessibility, and data acquisition capabilities. The conventional HVAC system component 502 includes a large number of wired connections 508 and wire guide passages 510 in the housing 506. This can be modified, as indicated by arrow 511, into the HVAC system component 504, which has substantially reduced wired connections 508 and modified wire guide passages 510 that limit the space required for the overall HVAC system. Wiring can be removed and internal structure reconfigured. In some embodiments, all wire guide passages 510 may be eliminated. This is achieved by employing wireless transceivers 512 to communicate data between internal system components (e.g., system components within the housing 506). Indeed present embodiments, reduce a number of wired connections by providing wireless connectivity within (inside the housing of) HVAC equipment.

Figure 5:
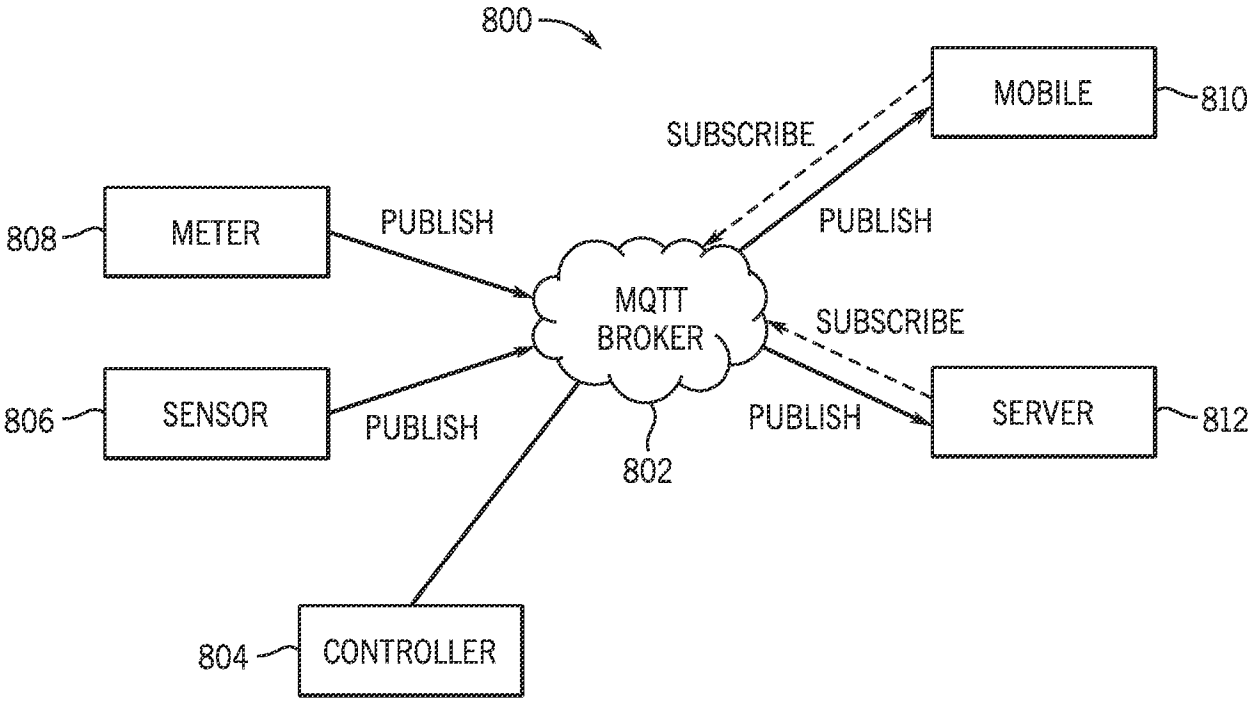
FIG. 5 is a schematic network diagram of a controller interacting with publishing device and subscribing devices via a broker, in accordance with embodiments of the present disclosure.

FIG. 5 is a schematic diagram of an HVAC system 800 incorporating a broker 802 (e.g., a Message Queuing Telemetry Transpor (MQTT) broker), which may be cloud-based or may reside on a controller 804 (e.g., the AHU controller 230 or the controller 402), in accordance with present embodiments. The controller 804 may communicate wirelessly with a sensing unit (e.g., sensing unit 418), HVAC devices (e.g., HVAC devices 426), a user interface (e.g., user interface 428), or other BACnet devices using one of a plurality of communication protocols, such as MQTT. The MQTT based communication includes one or more clients such as peripheral controllers (e.g., control board 422 of the sensing units 418) that may subscribe to one or more topics and/or publish one or more topics needed to perform their functions. The one or more topics may be, for example, control set point or temperature measurement.

The broker 802 (e.g., the controller 402) may operate to act as a middleman to receive one or more published topics and send related data to all clients who are subscribed to the topics. MQTT based communication may include one or more publishers such as meters (e.g., an airflow meter), sensors etc., and may further include one or more subscribers such as user interfaces of PC, mobile phones, servers etc. In the illustrated embodiment, a sensor 806 and a meter 808 operate as publishers by communicating observation-based data to the broker 802. Further, in the illustrated embodiment, a mobile device 810 and a server 812 operate as subscribers by subscribing to and receiving data dealt out by the broker 802. Essentially, based on a subscription relationship, the broker 802 publishes to the mobile device 810 and the server 812. MQTT based communication is a robust form of communication as MQTT communication supports quality of service features that allow clients to select one or more levels of services for receiving data. The MQTT based communication also supports other features such as delivery receipts, automatic repeated transmissions, and a handshake protocol. Such features ensure confidentiality and integrity of data communicated between entities.

Figure 6:
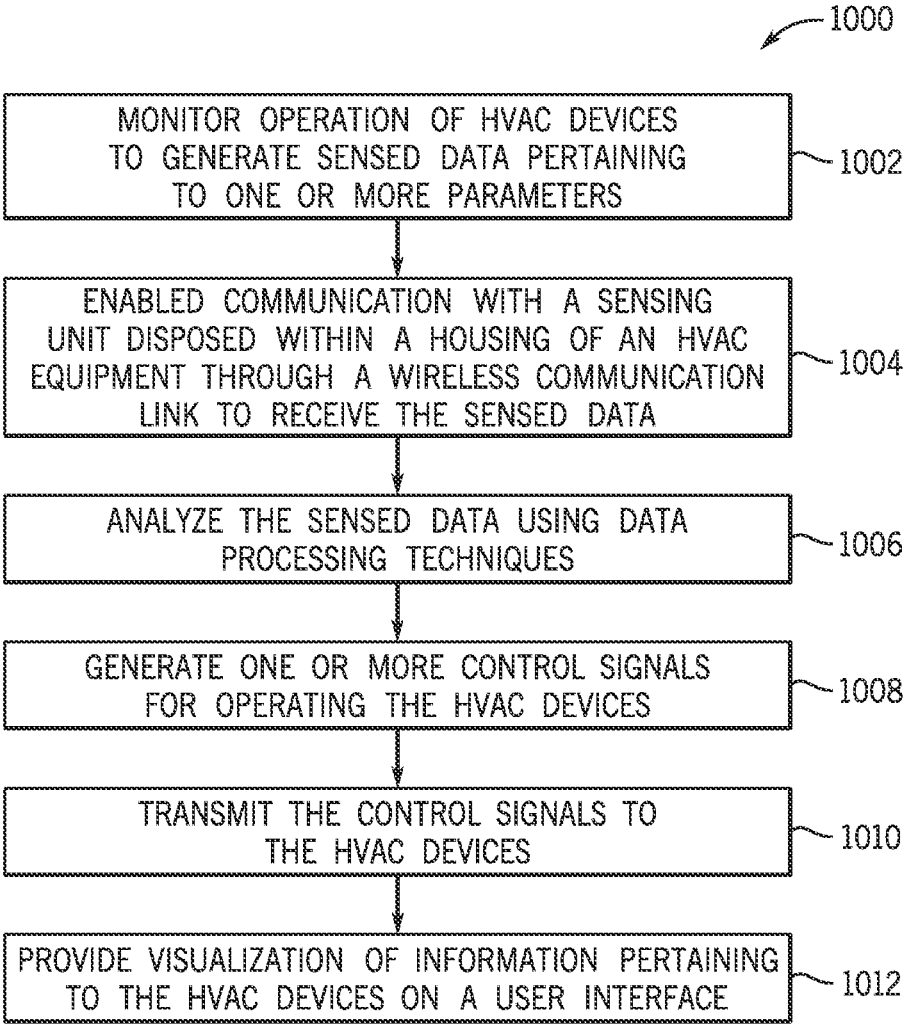
FIG. 6 is a flow diagram of a method, in accordance with embodiments of the present disclosure.

FIG. 6 is a flow diagram of a method 1000 for providing wireless connectivity within HVAC equipment (e.g., within a housing of a package unit) in accordance with embodiments of the present disclosure. The method 1000 is shown to include monitoring an operation of one or more HVAC devices to generate sensed data pertaining to one or more parameters (Step 1002). The one or more parameters may include temperature, humidity, pressure, air quality, fan speed, on/off states, CO2 levels, particulate matter (PM) levels, damper positions, valve positions, fan status, supply air temperature, supply air flowrate, zone occupancy, and so forth. The one or more parameters may be sensed by one or more sensors of a sensing unit disposed within a housing of the HVAC equipment. Further, a control board of the sensing unit may obtain one or more sensed signals from the sensors and process the sensed signals to generate sensed data. The sensed data may include one or more sensed values for the one or more parameters pertaining to the one or more HVAC devices.

The method 1000 is shown to include enabling communication by the controller disposed within the housing of the HVAC equipment with the sensing unit through a wireless communication link (Step 1004). The controller may communicate with the sensing unit using one or more of a plurality of communication protocols such as Wi-Fi, MQTT (Message Queueing Telemetry Transport), Lora WAN, Zigbee, Z-wave, NB-IOT (Narrow Band-Internet of things), RFID (Radio Frequency Identification), Bluetooth, NFC (Near Field Communication), and so forth. Further, the sensed data from the sensing unit may be received by the sensed data receiver through the wireless communication link.

The method 1000 is shown to include analyzing the sensed data using one or more data processing techniques (Step 1006). The sensed data may be analyzed using one or more data processing techniques for example artificial intelligence, neural network, machine learning such as decision trees etc. The sensed data may be analyzed by a sensed data analyzer. For example, the sensed data may be analyzed with respect to a pre-defined threshold range to determine if the sensed data is within the pre-defined threshold range. The sensed data may be processed and formatted by performing one or more operations such as data cleaning, data wrangling, data mining, filtering etc. In some embodiments, the sensed data may be transmitted to a cloud based control system to perform analysis of the sensed data.

The method 1000 is shown to include generating one or more control signals for operating the one or more HVAC devices (Step 1008). The one or more control signals may be generated by a control signal generator based on the analyzing of the sensed data performed by the sensed data analyzer. For example, the control signals may be generated for operating the one or more HVAC devices such as the drives and actuators based on the analysis of the sensed data performed by the sensed data analyzer.

The HVAC devices may be monitored and operated using any of a variety of control techniques (e.g., state-based control, on/off control, proportional control, proportional-integral (PI) control, proportional-integral-derivative (PID) control, extremum seeking control (ESC), model predictive control (MPC), etc.). In some embodiments, the control signals may include one or more commands for one or more actuators to set dampers and/or valves to specific positions to achieve a target value for a variable of interest (e.g., supply air temperature, supply air humidity, flow rate, etc.). In some embodiments, the control signals may include one or more commands for drives to operate at a specific operating speed or to achieve a specific airflow rate.

The method 1000 is shown to include transmitting the control signals to the one or more HVAC devices (Step 1010). In some embodiments, the control signals may be transmitted to the HVAC devices via the sensing unit through the wireless communication link. The control signals may be transmitted to the sensing unit, which may use the control signals as input to adjust positions of dampers, control relative proportions of outside air and return air provided to a building zone. For example, a control signal may be transmitted to the sensing unit to maintain speed of an HVAC device, such as variable frequency drive. In another example, a control signal may be transmitted to the sensing unit indicating one or more commands on when to turn on a compressor, speed of fans and position signal to set an economizer. In another embodiment, the control signals may be transmitted directly to the HVAC devices via a wireless communication link.

Further, a control logic may be used to adjust the control signals to achieve a target outcome. This may include varying signal strength by increasing power supplied for transmission based on positioning (e.g., location or orientation) of relevant transceivers and/or adjustment of directional orientation of transceivers. The control logic implemented by the control signal generator may also or alternatively vary a manipulated variable based on a received input signal (e.g., a set point). Such a set point may be received from a user interface (e.g., a thermostat), or other devices (e.g., a smart phone) connected to the HVAC equipment.

The method 1000 is further shown to include providing a visualization of information pertaining to the HVAC devices on a user interface (Step 1012). The visualization of information may allow a user of the user interface to access the HVAC devices directly from the user interface. For example, a user may be able to access the information such as sensed data for parameters, set points, status information, device identifiers, historical trend data or other applicable data associated with the one or more HVAC devices. Additionally, the user interface may allow users to provide one or more commands to modify the information pertaining to the HVAC devices such as set points etc. In some embodiments, the user interface may be configured to access and control the one or more HVAC devices using an application installed on the user interface. For example, the user interface may display one or more parameters such as temperature, humidity, fan speed, damper position. A user may select a parameter to view details pertaining to the selected parameter using the user interface and provide one or more commands to control the parameters.

The construction and arrangement of the systems and methods as shown in the various exemplary embodiments are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.). For example, the position of elements can be reversed or otherwise varied and the nature or number of discrete elements or positions can be altered or varied. Accordingly, all such modifications are intended to be included within the scope of the present disclosure. The order or sequence of any process or method steps can be varied or re-sequenced according to alternative embodiments. Other substitutions, modifications, changes, and omissions can be made in the design, operating conditions and arrangement of the exemplary embodiments without departing from the scope of the present disclosure.

The present disclosure contemplates methods, systems and program products on any machine-readable media for accomplishing various operations. The embodiments of the present disclosure can be implemented using existing computer processors, or by a special purpose computer processor for an appropriate system, incorporated for this or another purpose, or by a hardwired system. Embodiments within the scope of the present disclosure include program products comprising machine-readable media for carrying or having machine-executable instructions or data structures stored thereon. Such machine-readable media can be any available media that can be accessed by a general purpose or special purpose computer or other machine with a processor. By way of example, such machine-readable media can comprise RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. Combinations of the above are also included within the scope of machine-readable media. Machine-executable instructions include, for example, instructions and data which cause a general purpose computer, special purpose computer, or special purpose processing machines to perform a certain function or group of functions.

Although the figures show a specific order of method steps, the order of the steps may differ from what is depicted. Also two or more steps can be performed concurrently or with partial concurrence. Such variation will depend on the software and hardware systems chosen and on designer choice. All such variations are within the scope of the disclosure. Likewise, software implementations could be accomplished with standard programming techniques with rule based logic and other logic to accomplish the various connection steps, processing steps, comparison steps and decision steps.

What is claimed is:

1. A heating, ventilation, and/or air conditioning (HVAC) system configurable to control a temperature within a building, the HVAC system comprising:

an HVAC system housing, wherein the HVAC system housing is configured to be located within the building or on a roof of the building;

one or more sensing units disposed within the HVAC system housing; and a controller disposed within the HVAC system housing, wherein the controller is configured to:

communicate with the one or more sensing units through a wireless communication link to receive sensed data;

instruct the one or more sensing units to reorient to adjust a transmission direction of wireless communications from the one or more sensing units;

manage power supplied to the one or more sensing units to control a signal strength for the wireless communications from the one or more sensing units based on positional data for the one or more sensing units;

analyze the sensed data by applying one or more data processing techniques, wherein the one or more data processing techniques comprise an artificial intelligence, a neural network, one or more machine learning techniques, or any combination thereof; and analyze the sensed data by applying the one or more data processing techniques to:

generate one or more control signals to operate one or more HVAC devices; and provide a visualization of the sensed data and information pertaining to the one or more HVAC devices on a user interface.

2. The HVAC system of claim 1, wherein the HVAC system housing comprises a packaged terminal air conditioner (PTAC) unit housing, a roof top unit (RTU) housing, or a variable refrigerant flow (VRF) unit housing.

3. The HVAC system of claim 1, comprising one or more HVAC devices, wherein the one or more sensing units are configured to monitor an operation of the one or more HVAC devices to generate the sensed data pertaining to temperature, humidity, pressure, air quality, fan speed, or a combination thereof.

4. The HVAC system of claim 1, wherein the one or more sensing units include a control board that is configured to generate the sensed data based on one or more sensed signals provided by one or more sensors.

5. The HVAC system of claim 1, comprising one or more actuators configured to receive wirelessly transmitted instructions from the controller based on output from the analysis of the sensed data by applying the one or more data processing techniques.

6. The HVAC system of claim 1, wherein the controller is configured to communicate with the one or more sensing units using one of a plurality of communication protocols selected from a group consisting of Wi-Fi, MQTT (Message Queueing Telemetry Transport), Lora WAN, Zigbee, Z-wave, NB-IOT (Narrow Band-Internet of things), RFID (Radio Frequency Identification), Bluetooth, and NFC (Near Field Communication).

7. The HVAC system of claim 1, wherein the controller is configured to be powered using inductive coupling, capacitive coupling, piezoelectricity based charging, thermoelectric generator based charging, or a combination thereof.

8. The HVAC system of claim 1, wherein the controller and/or the one or more sensing units is configured to be powered using a rechargeable battery.

9. The HVAC system of claim 1, comprising an air handling unit (AHU), wherein the HVAC system housing is an AHU housing.

10. The HVAC system of claim 1, wherein the one or more sensing units comprises sensors with integral transceivers.

11. The HVAC system of claim 1, wherein the one or more sensing units are configured to articulate to facilitate directed wireless transmissions based on the controller instructing the one or more sensing units to reorient.

12. The HVAC system of claim 1, wherein the controller is configured to instruct an actuator to cause the one or more sensing units to reorient to adjust the wireless communication transmission direction.

13. A method comprising:

monitoring an operation of one or more heating, ventilation, and/or air conditioning (HVAC) devices disposed within an HVAC system housing with one or more sensing units disposed within the HVAC system housing, wherein the HVAC system housing is configured to be located within a building or on a roof of the building, and wherein the one or more HVAC devices are configured to control a temperature within the building;

generating, by the one or more sensing units, sensed data based on the monitoring;

reorienting, based on instructions from a controller disposed within the HVAC system housing, the one or more sensing units to adjust a transmission direction of wireless communications from the one or more sensing units;

adjusting, based on the instructions from the controller, power supplied to the one or more sensing units to control a signal strength for the wireless communications from the one or more sensing units based on positional data;

receiving, by the controller, the sensed data from the one or more sensing units via a wireless communication link;

analyzing, by the controller, the sensed data by applying one or more data processing techniques to generate one or more control signals to operate one or more HVAC devices, and provide a visualization of the sensed data and information pertaining to the one or more HVAC devices on a user interface, wherein the one or more data processing techniques comprise an artificial intelligence, a neural network, one or more machine learning techniques, or any combination thereof.

14. The method of claim 13, comprising wirelessly transmitting instructions based on the analyzing by the controller to one or more actuators within the HVAC system housing, wherein the one or more actuators each include a respective transceiver or each share a single transceiver for receiving the instructions.

15. The method of claim 13, wherein one or more actuators reorient the one or more sensing units based on the instructions from the controller to adjust the wireless communication transmission direction.

16. An air handling unit (AHU) configurable to control a temperature within a building, the AHU comprising:

an AHU housing, wherein the AHU housing is configured to be located within the building or on a roof of the building;

a controller disposed within the AHU housing and configured to analyze sensed data by applying one or more data processing techniques to generate one or more control signals to operate one or more HVAC devices, and provide a visualization of the sensed data and information pertaining to the one or more HVAC devices on a user interface;

a communications interface of the controller, wherein the communications interface is configured to transmit and receive communications wirelessly;

a sensor disposed within the AHU housing, wherein the sensor is configured to transmit the sensed data wirelessly to the controller via the communications interface; and an actuator disposed within the AHU housing, wherein the actuator is configured to receive instructions wirelessly from the communications interface and to reorient the sensor to adjust a transmission direction of wireless communications from the sensor based on the instructions;

wherein the controller is configured to control power and/or orientation of the sensor and/or the actuator to manage transmission quality of the sensed data and/or feedback from the actuator.

17. The AHU of claim 16, comprising an antenna extending from the AHU housing or disposed in an area of the AHU housing that is not a Faraday shield or cage, wherein the antenna is directly communicatively coupled with or part of the communications interface.

18. The AHU of claim 16, wherein the controller is configured to communicate with the one or more sensing units using one of a plurality of communication protocols selected from a group consisting of Wi-Fi, MQTT (Message Queueing Telemetry Transport), Lora WAN, Zigbee, Z-wave, NB-IOT (Narrow Band-Internet of Things), RFID (Radio Frequency Identification), Bluetooth, and NFC (Near Field Communication).

* * * * *